US005188234A

United States Patent [19]

Fukuda et al.

[11] Patent Number: 5,188,234

[45] Date of Patent: Feb. 23, 1993

[54] LUNCHBOX WITH CARRYING POUCH

[75] Inventors: Takeshi Fukuda, Osaka, Japan; Augusto A. Picozza, Orlando, Fla.

[73] Assignee: Dart Industries Inc., Deerfield, Ill.

[21] Appl. No.: 847,538

[22] Filed: Mar. 6, 1992

[51] Int. Cl.[5] ..... A45C 11/20

[52] U.S. Cl. ..... 206/541; 206/546; 206/553; 206/817; 220/529; 220/534

[58] Field of Search ..... 206/541, 546, 553, 817; 220/529, 534

[56] References Cited

U.S. PATENT DOCUMENTS

| | | | |
|---|---|---|---|
| D. 243,913 | 4/1977 | Miles . | |
| D. 251,284 | 3/1979 | Weaver . | |
| D. 318,400 | 7/1991 | Raucci . | |
| 319,932 | 6/1885 | Schneider . | |
| 1,257,057 | 2/1918 | White | 206/541 X |
| 1,373,156 | 3/1921 | Tebbetts | 206/546 |
| 2,324,381 | 7/1943 | Gonder et al. . | |
| 2,336,363 | 12/1943 | Mann . | |
| 4,640,392 | 2/1987 | Decker, Jr. et al. . | |

*Primary Examiner*—William I. Price
*Attorney, Agent, or Firm*—John A. Doninger

[57] ABSTRACT

A kit comprising a lunchbox and a carrying pouch slidably receiving the lunchbox therein. The lunchbox includes a container and cover with the cover including a recess receiving eating utensils. One eating utensil includes a projecting locking button releasably received within a pouch aperture for locking the lunchbox and utensils within the pouch. The pouch includes a spring member outwardly biasing a received lunchbox for ejection upon release of the lock button.

20 Claims, 5 Drawing Sheets

LUNCHBOX WITH CARRYING POUCH

BACKGROUND OF THE INVENTION

Temporary food containers of the type normally referred to as lunchboxes are almost universally known and used as a convenient means to store, protect and carry food, usually in the nature of a single meal. Such lunchboxes are most frequently used by school children.

Known lunchboxes, which are preferably inexpensive items, are frequently poorly made and have undesirable features including latching means which do not properly secure and/or are difficult to manipulate, especially for a young child.

Known lunchboxes in many instances also fail to adequately enclose and protect the food, and make no separate provision for eating utensils. Lunchboxes are also normally of a basic rectangular configuration not particularly adapted for maximum utilization of the interior space or for convenient carrying, for example within a child's bookbag or knapsack. In addition, little thought is given in the conventional lunchbox for protection of the box itself so as to maintain the integrity of the closure and the resultant protection of the contents.

SUMMARY OF THE INVENTION

The present invention comprises a highly practical and attractive lunchbox kit including a lunchbox in combination with a separate carrying pouch within which the lunchbox is releasably locked to both protectively enclose a major portion of the lunchbox and effectively retain the lunchbox cover in sealing position.

The lunchbox itself includes specific provision for the accommodation of two types of eating utensils exterior of the food-receiving interior or chamber of the lunchbox and so located as to, when positioned, generally follow the contours of the lunchbox to maintain the compact design thereof. The eating utensils are actually maintained in position by cooperative engagement with the lunchbox receiving pouch in a manner wherein at least one of the utensils functions as a manually releasable latch for retention of the lunchbox within the pouch, the pouch in turn retaining the utensils in position. Inasmuch as the pouch is to closely telescopically receive a major portion of the lunchbox stored therein, removal of the lunchbox is facilitated by spring means within the pouch which is resiliently compressed when the lunchbox is fully seated within the pouch and latched into position, and which, upon manual release of the latch, outwardly moves the lunchbox relative to the pouch a distance sufficient to insure a proper disengagement of the lunchbox from the closely conforming pouch and allow for complete removal of the lunchbox even by a young child.

Once removed from the pouch, the eating utensil or utensils associated with the lunchbox are released for removal and may in fact be used as a tool to facilitate removal of the sealed lunchbox cover.

Structurally, the lunchbox and pouch are molded of an appropriate rigid synthetic resinous material, for example high density polyethylene or polypropylene, having a slight degree of flexure sufficient to accommodate the snap mounting of the lunchbox cover as well as the engagement and release of the lunchbox relative to the pouch.

The lunchbox includes a flat base and is of a generally oval configuration with a container or container portion and a separate cover which locks thereto with snapinterfitting edge components. The rounded interior of the container provides for maximum utilization of the space and, as desired, can be partitioned by a removable partition which frictionally fits therein and has limited positional adjustment.

The cover includes a storage recess in the upper surface thereof which includes vertically extending dividers to properly orient and store multiple elongate eating utensil components, for example sectional chopsticks. The recess also accommodates a generally overlying eating utensil in the nature of a combination spoon and fork which rocks about a transverse axis or fulcrum point defined by selected ones of the dividers. The spoon/fork includes a vertically extending locking lug or button.

The pouch is in the nature of an open pocket which is configured to closely receive a major portion of the length of the closed lunchbox with the smaller end thereof introduced into the pocket. The pouch includes, in the top wall thereof, an opening which, upon alignment of the locking lug therewith, receives the lug and releasably retains the lunchbox within the pouch until the locking lug is manually depressed and moved outwardly relative to the opening.

In order to facilitate an actual release of the lunchbox from the pouch wherein t is snugly and protectively enclosed, the closed inner end of the pouch includes an integrally formed forwardly inclined spring flap or lever. The flap is rearwardly forced, resiliently and against the memory characteristics of the material, to align with the remainder of the pouch at the inner end thereof when the lunchbox is fully inserted and the lug locked into position. Upon release of the lug, the memory characteristics of the spring flap forwardly move and partially eject the lunchbox from the pouch, thus freeing the lunchbox for easy removal from the pouch.

Other features, objects and advantages of the invention are considered to reside in the details of construction and manner of use of the invention as will be more fully hereinafter set forth.

DESCRIPTION OF THE PREFERRED EMBODIMENTS

Figure 1:
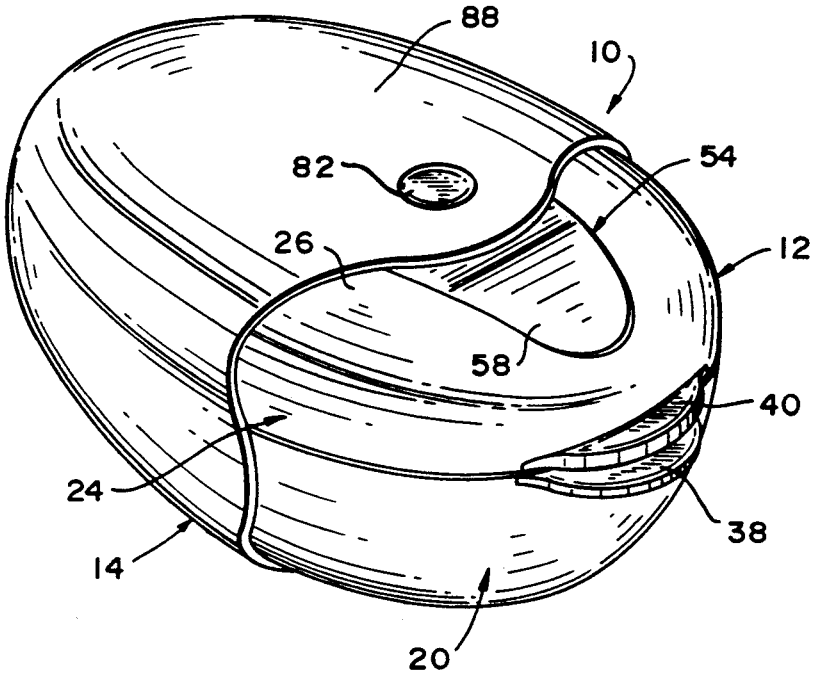
FIG. 1 is a perspective view of the lunchbox in locked position within the pouch.
Figure 2:
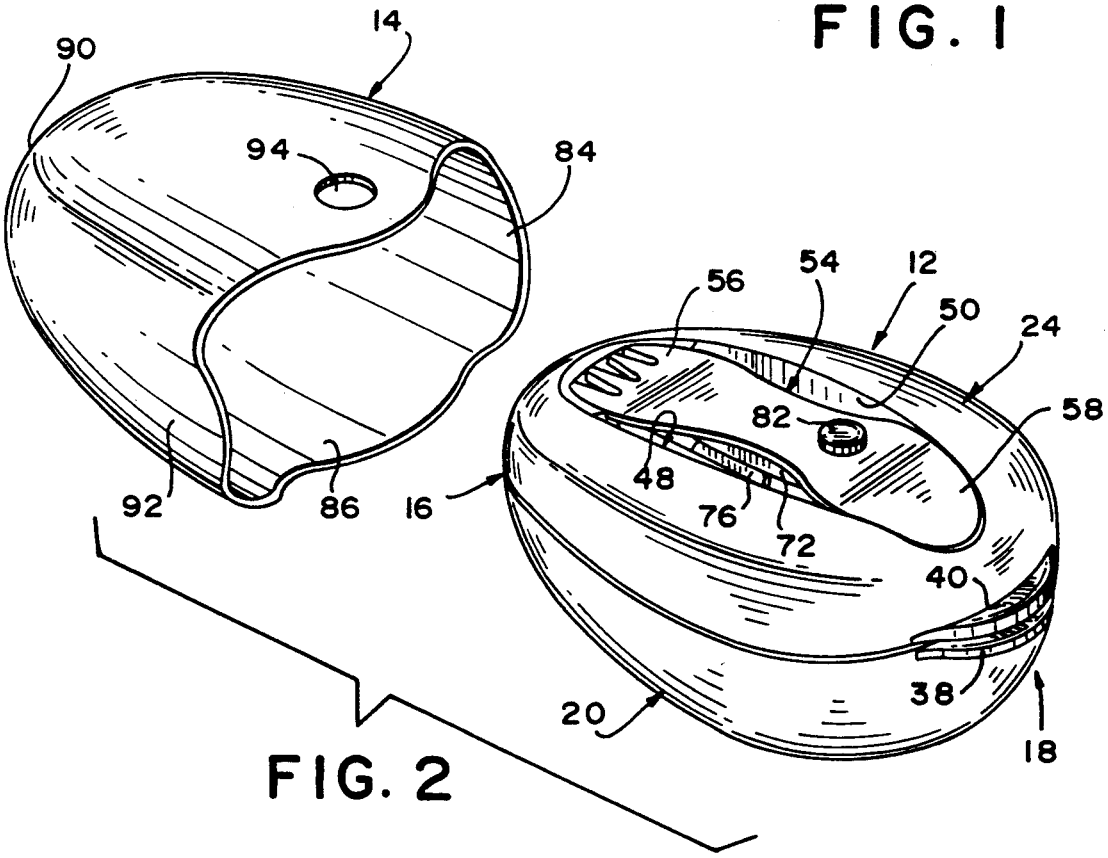
FIG. 2 is an exploded perspective view of the lunchbox and pouch.

Referring now more specifically to the drawings, the lunchbox kit 10 of the invention basically comprises a lunchbox 12 and a carrying pouch 14 adapted to receive the lunchbox.

The lunchbox 12 is of a generally oval configuration smoothly arcing from a narrow end portion 16 to a wide end portion 18. The lunchbox 12 basically includes a lower container 20 having a flat base 22, and an upper cover 24 of generally dome like configuration. The container 20 and cover 24, when assembled, present a smooth continuous outer surface both along the length and about the opposed ends 16 and 18 thereof, and transversely from the flat container base 22 and about the generally domed top portion 26 of the cover 24.

Figure 9:
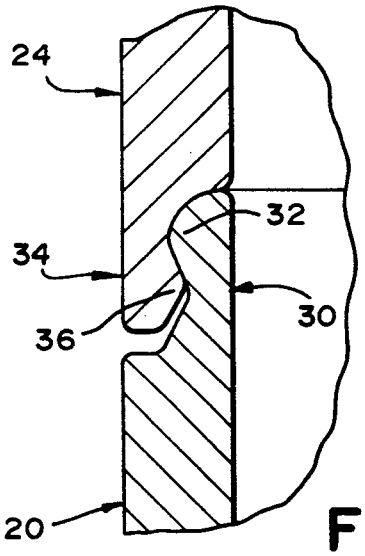
FIG. 9 is a cross sectional detail through the seal between the cover and container of the lunchbox.

The container 20 includes a peripheral wall 28 arcing upwardly from the base 22 and terminating in a substantially vertical upper edge lip 30 of a thickness approximately equal to one half the thickness of the wall 28. The lip 30 includes a peripherally continuous outwardly directed bulbous portion 32. The cover 24 includes a similar depending peripheral lip 34 defining the lower edge portion of the cover wall. An inwardly directed bulbous portion 36 on lip 34 complements the bulbous portion 32, snap-interlocking therewith through the inherent resiliency of the synthetic resinous material of the container 20 and cover 24 to provide a positive peripheral seal which both effectively seals the interior of the lunchbox and requires a positive manual effort for separation of the cover 24 from the container 20. When assembled, the joinder between the container and cover provide a smooth continuation of the inner and outer surfaces of the walls thereof. The minute spacing noted between the outer surfaces of the container and cover at the seal as illustrated in FIG. 9 insures a proper seating of the bulbous projections 32 and 36 with substantially no break in the inner wall surfaces. With regard to the inner wall surface of the container 20 in particular, as will be best appreciated from FIG. 3, this inner surface is continuous, smooth and both corner and projection free.

Figure 6:
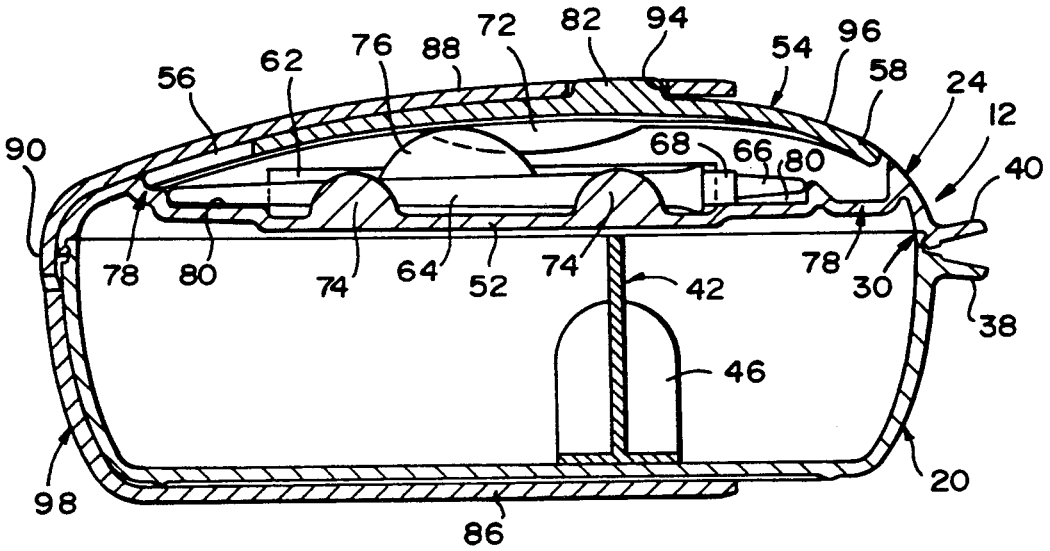
FIG. 6 is a longitudinal cross section through the lunchbox and pouch with the lunchbox fully seated and locked within the pouch.
Figure 7:
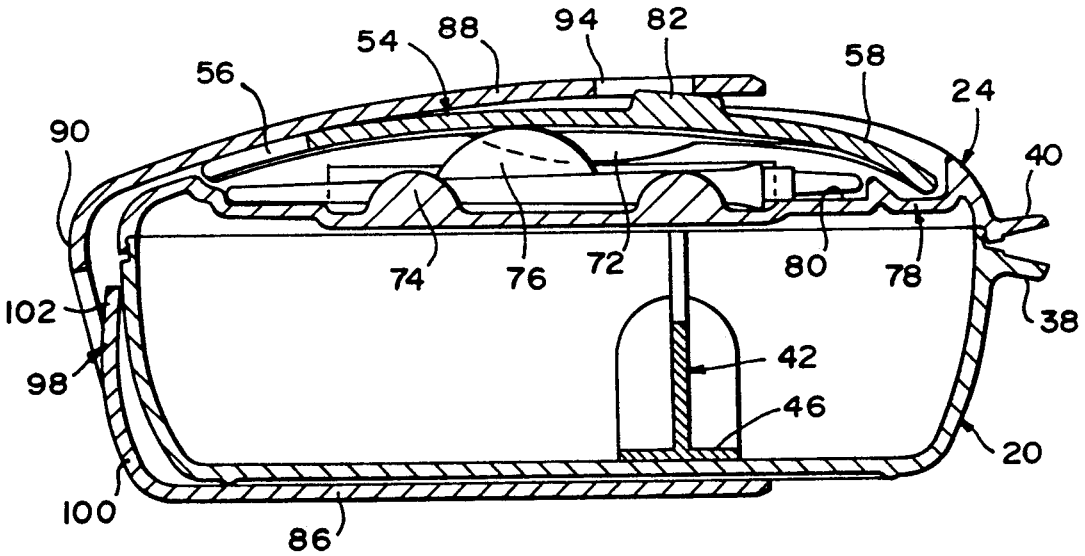
FIG. 7 is a cross sectional view similar to FIG. 6 with the latch means released and the lunchbox partially ejected from the pouch.
Figure 10:
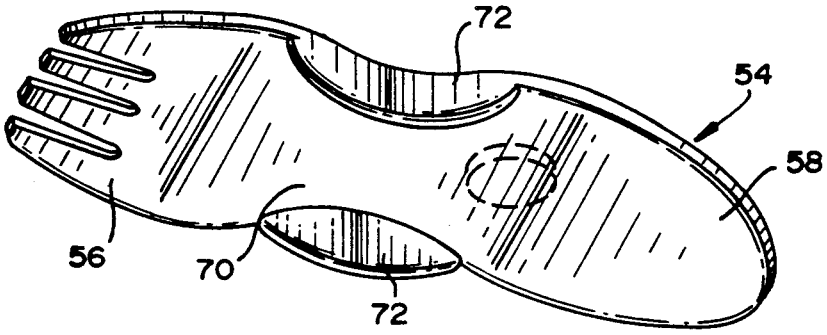
FIG. 10 is a perspective view of the spoon/fork eating utensil.

In order to facilitate an opening of the lunchbox 12, that is a removal of the cover 24, a pair of projecting arcuate tabs 38 and 40 are integrally formed with the respective ends of the container and cover at the large end portion 18 of the lunchbox 12. The tabs, noting FIGS. 6 and 7, are so positioned as to not interfere with the peripheral snap lock seal, and slightly outwardly diverge relative to each other whereby the fingers of a user, or an implement handled by the user, can be inserted between the tabs for outward movement of the tabs relative to each other to break the seal at the tabs with the cover subsequently peeled upward away from the container.

In order to enhance the versatility of the interior of the container 20, a removable partition 42 can be provided therein and transversely thereacross. The opposed vertical end edges 44 of the partition are so configured as to follow the contour of the interior surface of the container wall 28 and generally seal thereto. Stability to the partition 42 results from the provision of flat lateral extensions 46 which, at each end of the partition 42, extend along a portion of the lower edge thereof for seating on the flat bottom 22 of the container, and upwardly along the corresponding end edge 44, slightly inward thereof so as to not interfere with the line sealing of this end edge 44 with the container wall 28. The lateral extent of these stabilizing members 46 to each side of the partition 42 effect a positive positioning of the partition, particularly after the introduction of foodstuffs which can at least partially sit on the extensions 46. In light of the continuously curving nature of the wall 28 of the container 20 only a limited adjustment of the partition 42 along the length of the container will normally be possible if a relatively secure seal is to be retained between the partition 42 and the interior container wall surface. As illustrated, the partition is preferably located near the maximum width of the container, approximately one-third the length of the container inward from the larger end portion 18 thereof.

The lunchbox 12, and more particularly the cover 24 thereof, is provided with a central elongate upwardly opening storage recess or cavity 48 in the top portion thereof. The recess 48 is integrally formed within the cover 24 and includes a peripheral side wall 50 and a generally flat bottom wall 52 in a plane slightly above that of the lower peripheral lip 34 of the cover 24. The recess is particularly intended to accommodate and store eating utensils which include a basic wide elongate implement 54 preferably in the nature of a combined spoon and fork. This implement 54 is slightly arcuate with a fork head 56 defined at one end thereof and a spoon head 58 at the opposite end. Additional eating utensils, for example sectional chopsticks 60 as illustrated, can be received within the storage recess 48 below the utensil 54.

Figure 3:
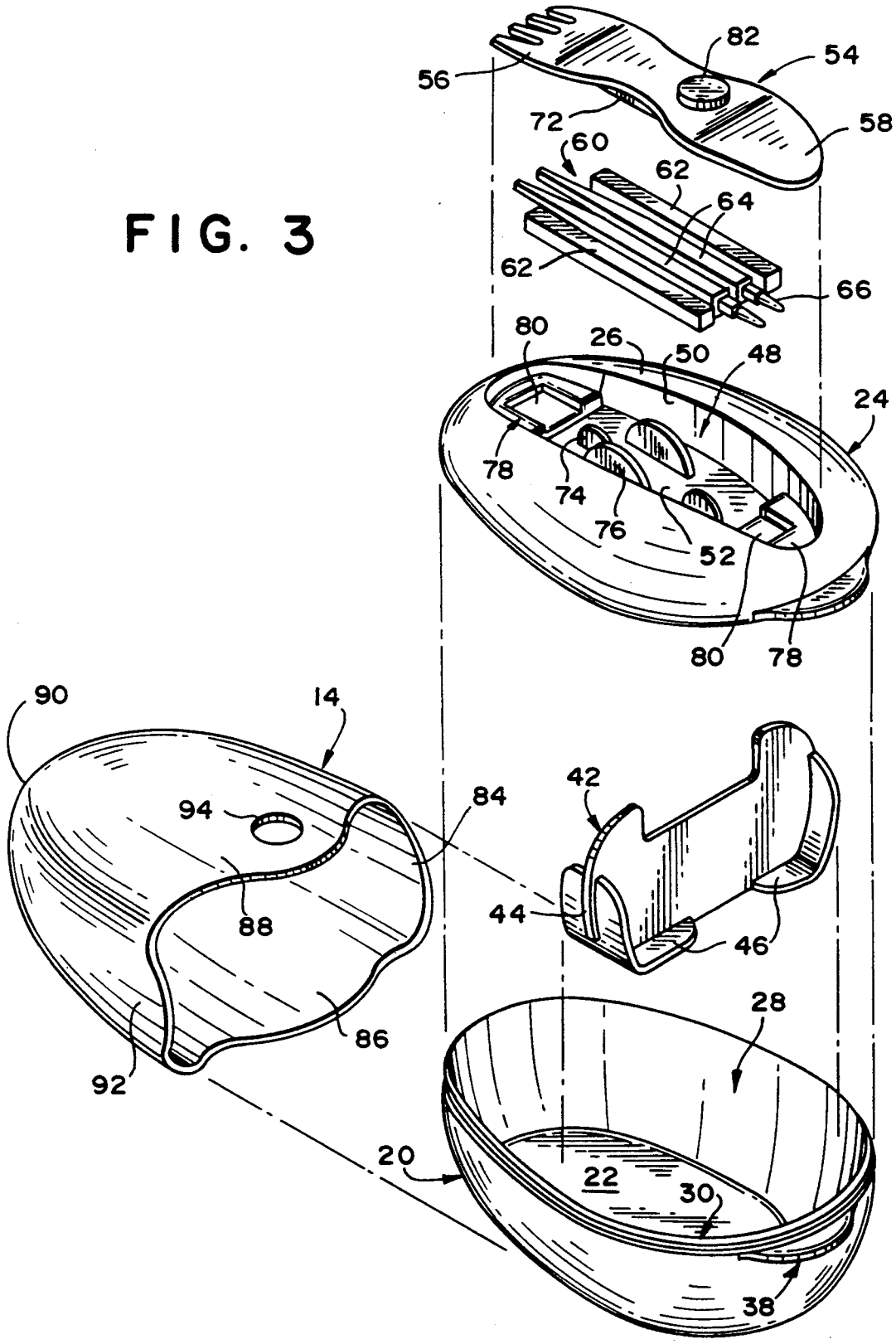
FIG. 3 is an exploded perspective view of the pouch, lunchbox components and lunchbox accessories.
Figure 4:
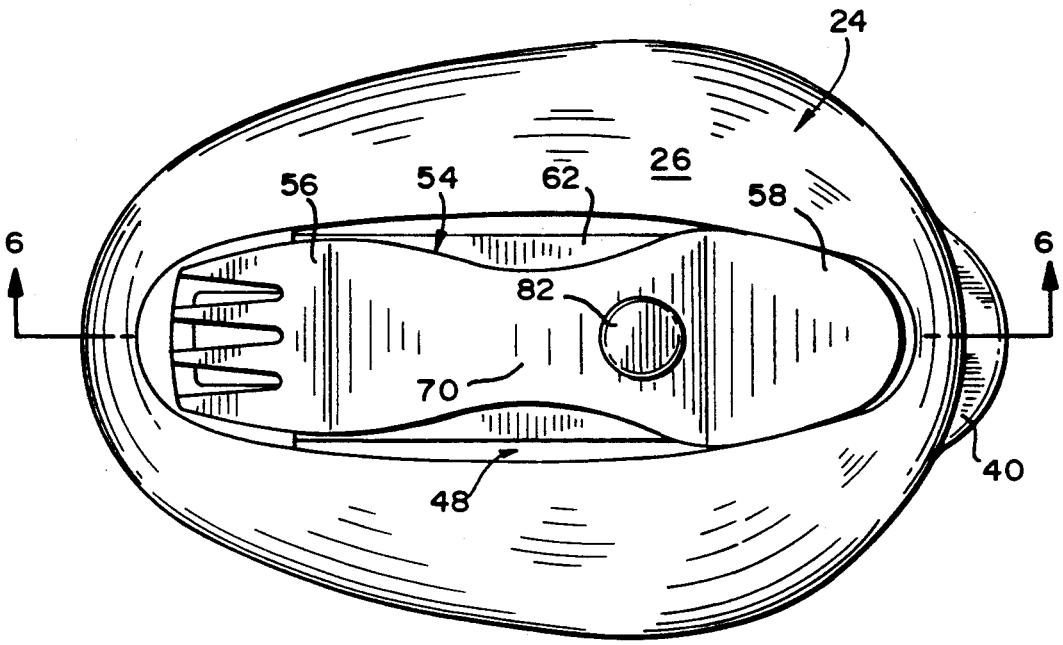
FIG. 4 is a top plan view of the lunchbox illustrating the spoon/fork in position.
Figure 11:
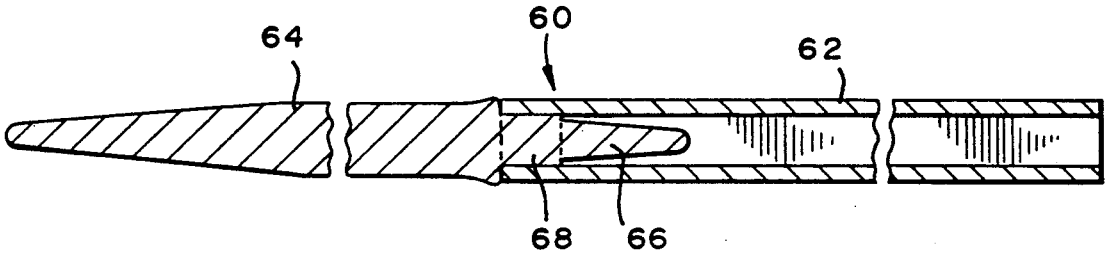
FIG. 11 is a cross sectional view illustrating one of the two chopsticks as assembled.
Figure 8:
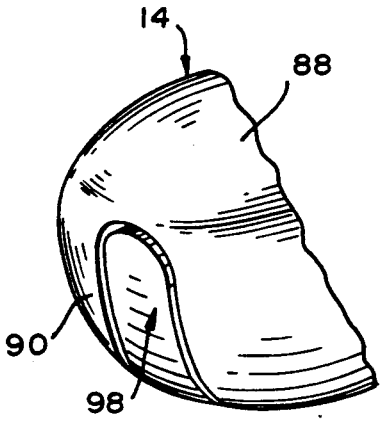
FIG. 8 is a partial perspective detail of the rear of the pouch illustrating the spring ejection means.

With specific reference to the illustrated utensils, each of the two sectional chopsticks 60 includes, noting FIGS. 3 and 11, an elongate hollow rectangular handle 62 and a solid elongate tapered stem 64. The stem 64 includes an axially projecting integral shaft 66 telescopically received within one end of the hollow handle 62 and including a collar portion 68 which frictionally locks within the hollow interior of the handle 62. A will be noted the stem shaft 66 and collar 68 are of a reduced diameter whereby the assembled handle and stem provide a substantially smooth exterior over the joinder area therebetween.

The spoon/fork 54 is slightly upwardly arced along the length thereof and includes a central narrow waist portion 70. This utensil 54 is rigidified, between the generally planar end portions 56 and 58, by a pair of integral flanges 72 generally coextensive with the waist portion 70 along the opposed edges thereof. The flanges depend from the concave side of the utensil 54 and include arcuate lower edges.

In order to accommodate the four chopstick components, the recess 48 is divided into four longitudinal compartments by two sets of dividers 74 and 76. The dividers 74 include two dividers longitudinally aligned along the longitudinal center line of the bottom wall 52 of the recess 48. The dividers 76 include a pair of dividers in spaced transverse alignment laterally outward to the opposite sides of the plane of the central dividers 74 and slightly offset from the transverse center of the recess 48 toward the smaller end 16 of the lunchbox 12, and hence the smaller end of the cover 24. All of the dividers are upwardly arced with the outer peripheral edges thereof being generally semi circular. The dividers 74 are of a height substantially equal to that of the longitudinally extending chopstick components received therebetween, while the dividers 76 extend substantially thereabove.

In positioning the chopstick components, the relatively shorter chopstick handles 62 are in the outermost compartments between each divider 76 and the adjacent recess wall 48. The relatively longer chopstick stems 64 are received immediately inward of each of the dividers 76 and between each of these dividers and the central dividers 74.

Figure 5:
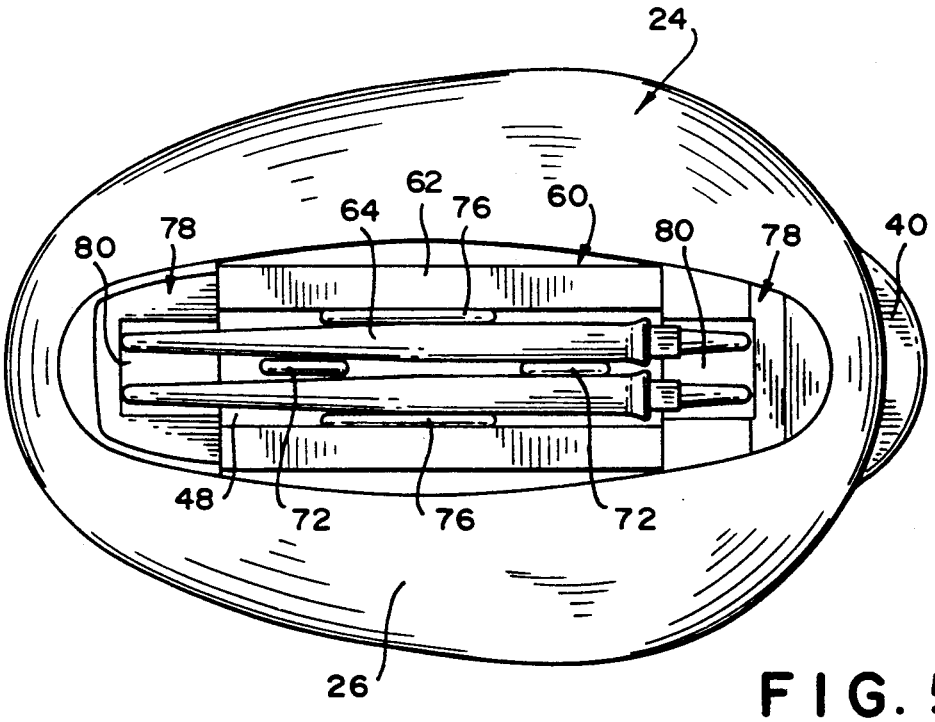
FIG. 5 is a top plan view of the lunchbox with the spoon/fork removed and illustrating the positioning of the chopsticks.

Longitudinal shifting of the chopstick components, which are generally rather freely received between the dividers, is precluded by a pair of end platforms 78 in the opposed ends of the recess 48 which define inner vertical faces against which the opposed ends of the chopstick handles abut. Each of the platforms 78 further includes a central depressed seat area 80 which in turn receives the opposed projecting relatively narrower end portions of the chopstick stems 64, including the narrow food gripping tips thereof and the opposed coupling extensions 66. The stored arrangement of the chopsticks 60 within the recess will be best appreciated from FIGS. 5 and 6.

The spoon/fork 54 overlies the stored chopsticks 60 with the depending reinforcing flanges 72 positioned immediately outward of the two central higher dividers 76. The dividers 76 in turn generally centrally support the spoon/fork 54 and define a transverse fulcrum point or line about which the utensil 54 can longitudinally rock. The height of the fulcrum-defining dividers 76 is such as to maintain the depending reinforcing flanges 72 of the spoon/fork 54 in vertically spaced relation above the underlying chopstick handles. The length of the spoon/fork 54, as well as the width of the relatively wider opposed end portions 56 and 58 thereof, is such as to be closely although freely accommodated within the upper portion of the recess 48 with the extreme longitudinal ends of the spoon/fork 54 selectively engageable with the opposed platform portions 78 upon a rocking of the spoon/fork as shall be described in more detail subsequently.

It is contemplated that the spoon/fork 54 be positioned within the recess 48 with the fork end portion 56 thereof directed toward the smaller end of the cover 24. So positioned, the fulcrum dividers 76 engage the spoon/fork 54 relatively closer to the fork end 56 thereof whereby the major portion of the length of the utensil 54 extends from the fulcrum to the spoon end portion 58 at the end of the recess 48 corresponding to the relatively larger or wider end of the cover 24, that end with the projecting tab 40.

The spoon/fork 54 is completed by an integral locking lug or button 82 projecting upwardly from the convex upper surface thereof generally along the longitudinal center line of the utensil 54 and relatively closer to the spoon end 58 thereof. Thus, and noting FIGS. 6 and 7 in particular, the locking button 82 is longitudinally offset from the fulcrum line, defined by the uppermost extremities of the laterally spaced dividers 76, whereby a downward pressure on the fork end 56 will cause a corresponding upward rocking of the spoon end 58 and an upward movement of the locking button 82.

It will be recognized that both eating utensils 54 and 60 are readily removed from and seated within the storage recess or cavity 48 and, other than for possibly a slight frictional engagement with the recess wall or dividers, are not fixed therein. Inasmuch as the utensils are to be reused, they are preferably of rather durable construction. As desired, the spoon/fork itself can be used to exert a levering action between the container and cove tabs 38 and 40 to initiate the opening of the lunchbox.

The carrying pouch 14, also formed of an appropriate substantially rigid synthetic resinous material, is of a one-piece construction defining a forwardly opening pocket adapted to snugly or closely receive the smaller end portion 16 of the closed lunchbox 12 and a major portion of the length thereof as best seen in FIGS. 1 and 6. The pouch 14 is formed as a unitary member with an open forward end or mouth 84, a generally flat bottom wall 86 adapted to receive the flat base 22 of the container 20, a slightly domed top wall 88 adapted to closely conform to the domed top wall portion 26 of the cover 24, an end wall 90 and opposed side walls 92 configured to conform to and closely receive the smaller end portion 16 of the lunchbox 12 and the adjoining side wall portions thereof.

The top wall 88 of the pouch 14 includes, toward the forward or outer mouth end thereof, a central aperture 94 which, upon a full seating of the lunchbox 12 within the pouch 14, receives the locking lug or button 82 upwardly therethrough. Thus, the utensil 54 is locked to the pouch 14 and, through an engagement of the utensil 54 within the recess 48, the lunchbox 12 itself is locked within the pouch 14.

With continued reference to FIG. 6 wherein the lunchbox is fully seated and locked within the pouch 14, it will be noted that the utensil or spoon/fork 54, through engagement of the convex upper surface of the fork end portion thereof with the overlying slightly arcuate top wall 88 of the pouch 14, effects a positive seating of the fork end 56 on the corresponding recess platform 78 in engagement with the end wall of the recess to preclude outward movement of the lunchbox 12 relative to the button secured utensil 54. Simultaneously, the utensil 54 is pivoted about the fulcrum-defining upper ends of the dividers 76 to raise the spoon end portion 58 thereof and effect a positive engagement of the locking button 82 within the aperture 94 in the top wall 88 of the pouch 14. At the same time, the convex upper surface of the spoon end portion 58 is positioned generally coplanar with the domed top wall portion 26 of the cover 24. To maintain a smooth exterior to the pouch 14, it is contemplated that the height of the locking button 82 be such as to, when engaged through the aperture 94, position the top or upper surface thereof flush with the outer surface of the top wall 88 of the pouch 14.

In order to release the lunchbox 12 from the carrying pouch 14, one need merely downwardly depress the locking button 82, relying on the inherent flexible resiliency of the spoon/fork 54, about the fulcrum point a sufficient distance to downwardly clear the aperture 94, after which the lunchbox can be forwardly drawn from the pouch. As an alternate to depressing the locking button 82, pressure can be applied to the relatively wider exposed upper surface of the spoon end 58 at approximately point 96, note FIG. 6.

Inasmuch as the lunchbox 12, when fully inserted within the carrying pouch 14, will be snugly received for a positive protective enclosure of the lunchbox and utensils thereon, and a positive retention of the cover 24 on the container 20 against accidental dislodgement even under relatively rough handling, a degree of resistance to withdrawal of the lunchbox after release of the locking button 82 may be encountered. Accordingly, the present invention also contemplates an automatic partial ejection of the lunchbox from the carrying pouch upon downward withdrawal of the locking button from the complementary aperture 94 in the top wall 88 of the carrying case 14.

This automatic ejection of the lunchbox 12 is effected by an ejection mechanism in the form of an integral spring flap or member 98 formed in and from the closed inner end wall 90 of the pouch 14. The spring member 98 extends vertically from a lower end 100 integral with the end wall 90 at approximately the joinder thereof with the bottom wall 86 and is otherwise free from the surrounding end wall 90 for the full remaining inverted U shaped periphery thereof. The spring member 98, noting FIG. 7 in particular, in an at-rest position arcs inwardly an appreciable distance relative to the end wall 90, terminating in a free upper end portion 102. The nature of the synthetic resinous material of the carrying pouch 14 is such whereby the spring member 98 includes a degree of flexible resiliency, and corresponding memory characteristic, sufficient to outwardly flex from its normal inwardly directed position of FIG. 7 to a stressed position coplanar with the end wall 90, as in FIG. 6, upon full introduction of the lunchbox 12. As previously noted, upon full introduction of the lunchbox 12, the locking button 82 engages within the aperture 94 and thus retains the lunchbox 12 against any tendency for the spring member 98 to eject or partially eject the lunchbox from the carrying pouch. Upon a freeing of the locking button 82, noting FIG. 7, the loaded spring member 98, through the memory characteristic thereof, forwardly moves and partially ejects the lunchbox from the carrying pouch. The substantial widening of the pouch outward toward the mouth or open end thereof provides for an increasingly freer movement of the lunchbox, or lessening of the frictional grip of the pouch on the lunchbox as the lunchbox moves outward from the pouch. As illustrated, it is preferred that the spring member 98 be of a height to position the upper end portion 102 thereof at approximately or slightly above mid height of the narrower end 16 of the lunchbox to allow for maximum transfer of the ejection force thereon.

As will be appreciated, the kit, when fully assembled, utilizes the carrying pouch as a means for retaining the eating utensils within the recess in the lunchbox cover. At the same time, one of the utensils functions as a means for locking the lunchbox and utensils within the carrying pouch. The pouch also functions as an effective means for additionally securing the lunchbox cover to the lunchbox container, thus avoiding any potential for an accidental opening of the lunchbox even under rough handling situations.

The foregoing is illustrative of the invention. However, as obvious variations may occur to those skilled in the art, it is not desired to limit the invention to the exact construction and manner of use shown and described.

We claim:

1. A kit including a lunchbox and a carrying pouch; said lunchbox comprising a container and a cover selectively mounted in overlying relation to and closing said container; said pouch defining a pocket with an open forward end; said lunchbox, including said container with said cover mounted thereon, being selectively received within said pocket through said open forward end, ejection means for forcible outward movement of said lunchbox relative to said pocket through said open end, and latch means engaged between said lunchbox and said pouch for releasably retaining said lunchbox in said pocket and precluding outward movement of said lunchbox by said ejection means.

2. The kit of claim 1 wherein said pouch comprises a top wall, a bottom wall and an inner end wall remote from said open forward end of said pocket, said ejection means comprising a spring member on said pouch at said inner end wall, said spring member extending forwardly to a position within said pocket and being resiliently rearwardly retracted by and upon reception of said lunchbox within said pocket, said spring member, upon release of said latch means, being of sufficient strength to forwardly move said lunchbox and return said spring member to its forwardly extending position within said pocket.

3. The kit of claim 2 wherein said spring member is integrally formed from said inner end wall.

4. The kit of claim 3 wherein said latch means comprises a locking element mounted on said lunchbox cover and extending upwardly relative thereto, and a complementary keeper on said top wall of said pouch selectively receiving and retaining said locking element upon alignment therebetween.

5. The kit of claim 4 including an upwardly directed storage recess in said lunchbox cover, at least one eating utensil removably received within said recess and retained by said recess against general longitudinal and lateral movement therein.

6. The kit of claim 5 wherein said locking element is on said utensil and projects upwardly therefrom.

7. The kit of claim 6 wherein said utensil comprises an elongate member, fulcrum means in said recess pivotally supporting said member, said member, with said lunchbox received within said pocket, including a first rear portion extending inward of said fulcrum means toward said inner end wall of said pouch, and a second forward portion extending outward of said fulcrum means toward said open forward end of said pocket, said first portion engaging said top wall of said pouch and upwardly pivoting said second portion about said fulcrum means, said second portion mounting said locking element, said locking element engaging within said top wall keeper upon an upward pivoting of said second portion.

8. The kit of claim 7 wherein said member possesses sufficient resilient flexibility for manual depression of said second forward portion thereof for disengagement of said locking element from said keeper.

9. The kit of claim 8 wherein said keeper comprises an aperture defined through said top wall of said pouch, said locking element, upon alignment therewith, extending through said aperture for direct manual access thereto from the top of said pouch.

10. The kit of claim 1 wherein said latch means includes a locking element mounted on said lunchbox cover and extending upwardly relative thereto, and a complementary keeper on said top wall of said pouch selectively receiving and retaining said locking element upon alignment therebetween.

11. The kit of claim 10 including an upwardly directed storage recess in said lunchbox cover, at least one eating utensil mountable within said recess and retained by said recess against general longitudinal and lateral movement therein, said locking element being on said utensil with said utensil engaged between said lunchbox and said pouch.

12. The kit of claim 11 wherein said utensil comprises an elongate member, fulcrum means in said recess pivotally supporting said member, said ember, with said lunchbox received within said pocket, including a first rear portion extending inward of said fulcrum means toward said inner end wall of said pouch, and a second forward portion extending outward of said fulcrum means toward said open forward end of said pocket, said first portion engaging said top wall of said pouch and upwardly pivoting said second portion about said fulcrum means, said second portion mounting said locking element, said locking element engaging within said top wall keeper upon an upward pivoting of said second portion, said member possessing sufficient resilient flexibility for manual depression of said second forward portion thereof for disengagement of said locking element from said keeper.

13. The kit of claim 12 wherein said recess includes projecting dividers therein defining multiple compartments for the selective reception of additional eating utensils, selective ones of said dividers defining said fulcrum means.

14. A combination lunchbox and carrying pouch, said lunchbox comprising a container with a cover removably mounted thereover and closing said container; said pouch defining a pocket with an open forward end, said lunchbox being selectively introduced into and removed from said pocket through said open forward end, a separate utensil overlying said lunchbox and selectively received between said lunchbox and said pouch upon introduction of said lunchbox within said pocket, means engaged between said utensil and said lunchbox preventing relative movement therebetween in the direction of movement of said lunchbox relative to said pocket upon introduction thereto and removal therefrom, and latch means on said utensil and pouch for selective and releasable locking of said utensil and said lunchbox within said pocket.

15. The combined lunchbox and pouch of claim 14 wherein said latch means includes a locking element on said utensil projecting outwardly therefrom, and a keeper defined in said pouch selectively receiving said locking element.

16. The combined lunchbox and pouch of claim 15 including a storage recess in said cover receiving said utensil, said utensil comprising an elongate member, fulcrum means in said recess pivotally supporting said member, said member, with said lunchbox received within said pocket, including a first rear portion extending inward of said fulcrum means relative to said open forward end, and a second forward portion extending outward of said fulcrum means toward said open forward end of said pocket, said first portion engaging said pouch and upwardly pivoting said second portion about said fulcrum means, said second portion mounting said locking element, said locking element engaging within said keeper upon an upward pivoting of said second portion.

17. The combined lunchbox and pouch of claim 16 wherein said utensil possesses sufficient resilient flexibility for manual depression of said second forward portion thereof for disengagement of said locking element from said keeper.

18. A lunchbox comprising a container with an open top, a cover removably mounted to said container over and closing said open top, an elongate upwardly opening recess defined in said cover, at least one eating utensil, means for releasably retaining said at least one utensil in said recess, and means for releasably sealing said cover to said container about the open top of said container.

19. The lunchbox of claim 18 including divider means in said recess dividing said recess into multiple compartments, said at least one eating utensil overlying said dividers and said compartments, and at least one additional eating utensil defined by separable components received within said compartments below said at least one eating utensil.

20. The lunchbox of claim 19 wherein said container and mounted cover are of substantially oval configuration and including rounded end portions, one of said end portions including a pair of outwardly projecting tabs respectively on said container and said cover adjacent the open top of said container and in slightly spaced vertical alignment for selective engagement therebetween of means for outwardly moving said tabs relative to each other and effecting an initiation of removal of said cover from said container.

* * * * *